US010340595B2

(12) United States Patent
Kuo et al.

(10) Patent No.: US 10,340,595 B2
(45) Date of Patent: Jul. 2, 2019

(54) DIPOLE ANTENNA

(71) Applicant: ARCADYAN TECHNOLOGY CORPORATION, Hsinchu (TW)

(72) Inventors: Shin-Lung Kuo, Kaohsiung (TW); Shih-Chieh Cheng, Tainan (TW)

(73) Assignee: ARCADYAN TECHNOLOGY CORPORATION, Hsinchu (TW)

( * ) Notice: Subject to any disclaimer, the term of this patent is extended or adjusted under 35 U.S.C. 154(b) by 0 days.

(21) Appl. No.: 15/817,475

(22) Filed: Nov. 20, 2017

(65) Prior Publication Data

US 2019/0058252 A1 Feb. 21, 2019

(30) Foreign Application Priority Data

Aug. 18, 2017 (TW) ..... 106212296 U

(51) Int. Cl.

| | |
|---|---|
| ***H01Q 9/16*** | (2006.01) |
| ***H01Q 5/335*** | (2015.01) |
| ***H01Q 9/28*** | (2006.01) |
| ***H01Q 5/10*** | (2015.01) |
| ***H01Q 21/06*** | (2006.01) |

(52) U.S. Cl.

CPC ..... *H01Q 5/335* (2015.01); *H01Q 5/10* (2015.01); *H01Q 9/16* (2013.01); *H01Q 9/28* (2013.01); *H01Q 21/062* (2013.01); *H01Q 21/065* (2013.01)

(58) Field of Classification Search

CPC ..... H01Q 5/335; H01Q 21/065; H01Q 9/16; H01Q 21/062

USPC ..... 343/822, 795

See application file for complete search history.

(56) References Cited

U.S. PATENT DOCUMENTS 7,636,069 B2 * 12/2009 Wong ..... H01Q 9/285 343/795

2017/0222335 A1 * 8/2017 Tsai ..... H01Q 5/371

* cited by examiner

*Primary Examiner* — Jean B Jeanglaude

(74) *Attorney, Agent, or Firm* — WPAT, PC

(57) ABSTRACT

A dipole antenna is provided, which may include a substrate, a first radiator and a second radiator disposed thereon. The substrate may include a first metal layer and a second metal layer; the first metal layer may include a feed point connected to the signal wire of a coaxial cable; the second metal layer may include a ground point connected to the ground layer of the coaxial cable. The first radiator may include a first planar connection part and a first solid radiating part; the first planar connection part may be disposed on one end of the first solid radiating part and connected to the first metal layer. The second radiator may include a second planar connection part and a second solid radiating part; the second planar connection part may be disposed on one end of the second solid radiating part and connected to the second metal layer.

15 Claims, 7 Drawing Sheets

DIPOLE ANTENNA

CROSS REFERENCE TO RELATED APPLICATION

All related applications are incorporated by reference. The present application is based on, and claims priority from, Taiwan Application Serial Number 106212296, filed on Aug. 18, 2017, the disclosure of which is hereby incorporated by reference herein in its entirety.

TECHNICAL FIELD

The technical field relates to an antenna, in particular to a dipole antenna.

BACKGROUND

In general, a dual-band dipole antenna installed in an access point or a router includes two hollow cylindrical radiators, and the two radiators are connected to each other by a coaxial cable, and each is sleeved by a heat-shrinkable sleeve. However, the above conventional dual-band dipole antenna still has a lot of shortcomings to be improved.

For example, the two radiators of the conventional dual-band dipole antenna are only connected by one coaxial cable, and sleeved by the heat-shrinkable sleeves; thus, its structural strength is low; for the reason, the conventional dual-band dipole antenna tends to be broken due to external force, which significantly increases the failure rate of the conventional dual-band dipole antenna.

Besides, as the radiators of the conventional dual-band dipole antenna are hollow cylinders, which should be manufactured by lathing solid metal cylinders; thus, the above manufacturing process will generate a lot of waste materials, which significantly increases the cost of the conventional dual-band dipole antenna.

Moreover, as the radiators of the conventional dual-band dipole antenna should be manufactured by lathing solid metal cylinders, its size cannot be easily controlled; thus, it is very hard to adjust the characteristics of the conventional dual-band antenna, which significantly limits the application of the conventional dual-bank antenna.

Furthermore, as the radiators of the conventional dual-band dipole antenna are hollow cylinders, so cannot be moved by a nozzle, and cannot be fixed on a printed circuit board; thus, the conventional dual-band dipole antenna can only be manually installed on a printed circuit board rather than the surface mount technology (SMT); therefore, the assembly of the conventional dual-band dipole antenna is of low efficiency.

Accordingly, it has become an important issue to improve the shortcomings of the conventional dual-band dipole antenna.

SUMMARY

A dipole antenna is provided, which may include a substrate, a first radiator and a second radiator disposed thereon. The substrate may include a first metal layer and a second metal layer; the first metal layer may include a feed point connected to the signal wire of a coaxial cable; the second metal layer may include a ground point connected to the ground layer of the coaxial cable. The first radiator may include a first planar connection part and a first solid radiating part; the first planar connection part may be disposed on one end of the first solid radiating part and connected to the first metal layer. The second radiator may include a second planar connection part and a second solid radiating part; the second planar connection part may be disposed on one end of the second solid radiating part and connected to the second metal layer.

In a preferred embodiment of the present disclosure, the substrate may further include an isolation layer, disposed between the first metal layer and the second metal layer.

In a preferred embodiment of the present disclosure, the first solid radiating part and the second solid radiating part may be rectangular hollow columns, and the hollow column may have two openings at two opposite ends thereof respectively.

In a preferred embodiment of the present disclosure, the first solid radiating part and the second solid radiating part may be rectangular hollow columns, and the hollow column may be not completely sealed and may have two openings at two opposite ends thereof respectively.

In a preferred embodiment of the present disclosure, the first radiator further may include a first planar extension part disposed at the other end of the first solid radiating part, and the second radiator may further include a second planar extension part disposed at the other end of the second solid radiating part.

In a preferred embodiment of the present disclosure, the distance between the feed point and the other end of the first solid radiating part, and the distance between the ground point and the other end of the second solid radiating part may be $\frac{1}{4}\lambda$.

In a preferred embodiment of the present disclosure, the impedance matching of the dipole antenna can be adjusted by modifying the distance between the first solid radiating part and the second solid radiating part.

In a preferred embodiment of the present disclosure, the impedance matching of the dipole antenna can be adjusted by modifying the distance between the first planar connection part and the second planar connection part.

In a preferred embodiment of the present disclosure, the resonance between the first solid radiating part and the second solid radiating part can be adjusted by modifying the height of the first solid radiating part and the height of the second solid radiating part.

In a preferred embodiment of the present disclosure, the operating frequency bands of the dipole antenna may include a first frequency band and a second frequency band; the first frequency band may be higher than the second frequency band; the first frequency band can be adjusted by modifying the distance between the first solid radiating part and the second solid radiating part.

In a preferred embodiment of the present disclosure, the first solid radiating part may include a first lateral opening, and the second solid radiating part may include a second lateral opening; the direction which the first lateral opening faces may be contrary to the direction which the second lateral opening.

In a preferred embodiment of the present disclosure, the first radiator may include a first gap, and the first gap may penetrate through the first planar connection part, the bottom of the first solid radiating part and the first planar extension part; the second radiator may further include a second gap, and the second gap may penetrate through the second planar connection part, the bottom of the second solid radiating part and the second planar extension part.

In a preferred embodiment of the present disclosure, the second frequency band can be adjusted by modifying the distance between the feed point and the other end of the first solid radiating part, and the distance between the ground point and the other end of the second solid radiating part.

A dipole antenna is further provided, which may include a substrate, a first radiator and a second radiator. The first radiator may be disposed on the substrate, wherein the first radiator may be formed by bending a first metal board, and may include a first planar connection part and a first solid radiating part; the first planar connection part may be disposed on one end of the first solid radiating part. The second radiator may be disposed on the substrate, wherein the second radiator may be formed by bending a second metal board, and may include a second planar connection part and a second solid radiating part; the second planar connection part may be disposed on one end of the second solid radiating part. The first radiator and the second radiator may be disposed on the same side of the substrate, and the first planar connection part may be opposite to the second planar connection part.

In a preferred embodiment of the present disclosure, the substrate may include a first metal layer and a second metal layer; the first metal layer and the second metal layer may be disposed on the same side of the substrate and adjacent to each other; the first metal layer may be connected to the first planar connection part, and may include a feed point; the feed point may be connected to a signal wire of a coaxial cable; the second metal layer may be connected to the second planar connection part, and may include a ground point; the ground point may be connected to a ground layer of the coaxial cable.

In a preferred embodiment of the present disclosure, the operating frequency bands of the dipole antenna may include a first frequency band and a second frequency band; the first frequency band may be higher than the second frequency band; the first frequency band can be adjusted by modifying a distance between the first solid radiating part and the second solid radiating part.

In a preferred embodiment of the present disclosure, the second frequency band can be adjusted by modifying the distance between the feed point and the other end of the first solid radiating part, and the distance between the ground point and the other end of the second solid radiating part.

In summation of the description above, the dipole antenna according to the exemplary embodiments of the present disclosure may have the following advantages:

(1) In one embodiment of the present disclosure, the first radiator and the second radiator of the dipole antenna can be fixed on the substrate (printed circuit board), so its structural strength can be obviously increased; therefore, the dipole antenna will not be easily broken by external force, so its failure rate can be extremely low.

(2) In one embodiment of the present disclosure, the first radiator and the second radiator of the dipole antenna may be of rectangle or other polygons, so can be directly manufactured by bending metal boards without generating any waste material; thus, the cost of the dipole antenna can be further reduced.

(3) In one embodiment of the present disclosure, the first radiator and the second radiator of the dipole antenna can be directly manufactured by bending metal boards, so its size can be easily controlled, and its characteristics can also be easily adjusted; therefore, the application of the dipole antenna can be more comprehensive.

(4) In one embodiment of the present disclosure, the first radiator and the second radiator of the dipole antenna may be of rectangle or other polygons, so the dipole antenna can be easily installed on a printed circuit board and moved by a nozzle; therefore, the dipole antenna can be directly installed on a printed circuit board by the surface mount technology (SMT); therefore, the assembly of the dual-band dipole antenna is of high efficiency.

(5) In one embodiment of the present disclosure, the dipole antenna can achieve better performance, and can be adjusted to have one operating frequency band or two operating frequency bands; thus, the dipole antenna can be a single-band antenna or a dual-band antenna, so is more flexible in use.

Further scope of applicability of the present application will become more apparent from the detailed description given hereinafter. However, it should be understood that the detailed description and specific examples, while indicating exemplary embodiments of the disclosure, are given by way of illustration only, since various changes and modifications within the spirit and scope of the disclosure will become apparent to those skilled in the art from this detailed description.

BRIEF DESCRIPTION OF THE DRAWINGS

The present disclosure will become more fully understood from the detailed description given herein below and the accompanying drawings which are given by way of illustration only, and thus are not limitative of the present disclosure and wherein.

DETAILED DESCRIPTION

Figure 1:
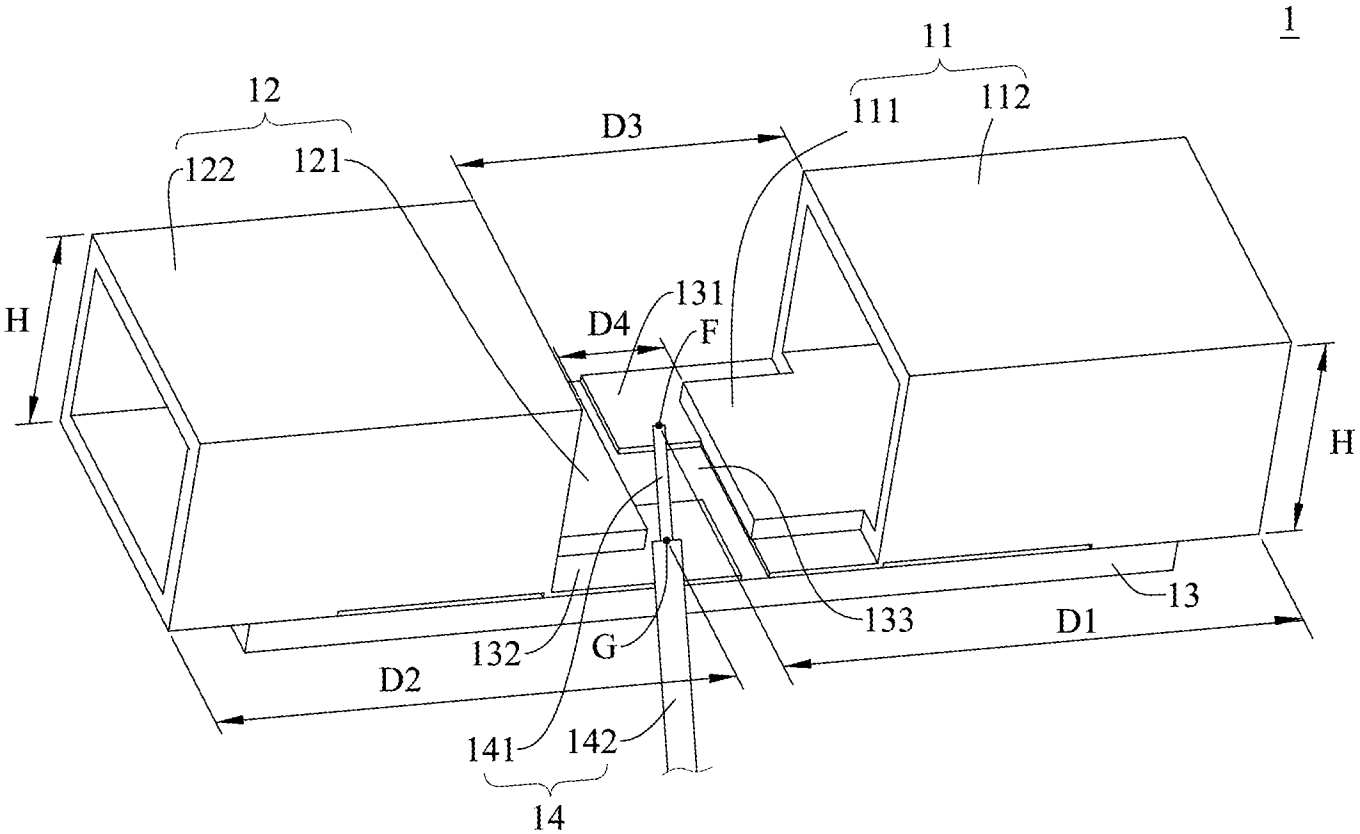
FIG. 1 is a first schematic view of a first embodiment of a dipole antenna of in accordance with the present disclosure.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

Figure 2:
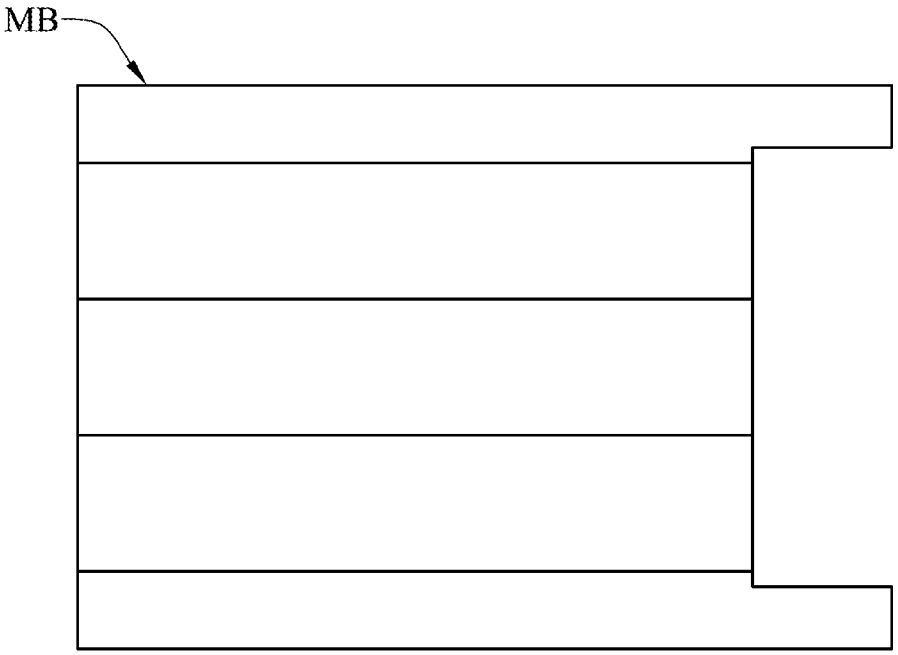
FIG. 2 is a second schematic view of the first embodiment of the dipole antenna of in accordance with the present disclosure.

Please refer to FIG. 1 and FIG. 2, which are a first schematic view and a second schematic view of a first embodiment of a dipole antenna of in accordance with the present disclosure respectively; as shown in FIG. 2, the dipole antenna 1 may include a substrate 13, a first radiator 11 and a second radiator 12.

The substrate 13 may include a first metal layer 131, a second metal layer 132 and an isolation layer 133. The first metal layer 131 and the second metal layer 132 may be disposed on the same side of the substrate 13, and may be adjacent to each other; the isolation layer 133 may be disposed between the first metal layer 131 and the second metal layer 132; the first metal layer 131 may include a feed point F, and the feed point F may be connected to the signal wire 141 of the coaxial cable 14; the second metal layer 132 may include a ground pint G, and the ground pint G may be connected to the ground layer 142 of the coaxial cable 14; in a preferred embodiment, the substrate 13 may be a printed circuit board (PCB), etc.

The first radiator 11 may be fixed on the substrate 13, and may include a first planar connection part 111 and a first solid radiating part 112; the first solid radiating part 112 may be a hollow rectangular hollow column, and may have two openings at two opposite ends thereof respectively; the first planar connection part 111 may be disposed on one end of the first solid radiating part 112 and may be connected to the first metal layer 131; the distance D1 between the feed point F and the other end of the first solid radiating part 112 may be ¼λ; in the embodiment, the first solid radiating part 112 may be rectangular; in another preferred embodiment, the first solid radiating part 112 may be polygonal.

The second radiator 12 may be fixed on the substrate 13, and may include a second planar connection part 121 and a second solid radiating part 122; similarly, the second solid radiating part 122 may be a hollow rectangular hollow column, and may have two openings at two opposite ends thereof respectively; the second planar connection part 121 may be disposed on one end of the second solid radiating part 122 and may be connected to the second metal layer 132; the distance D2 between the ground point G and the other end of the second solid radiating part 122 may be ¼λ; in the embodiment, the second solid radiating part 122 may be rectangular; in another preferred embodiment, the second solid radiating part 122 may be polygonal. In the embodiment, the first radiator 11 and the second radiator 12 may be fixed on the same side of the substrate 13, and the first planar connection part 111 of the first radiator 11 may face the second planar connection part 121 of the second radiator 12.

As described above, the first radiator 11 and the second radiator 13 of the dipole antenna 1 according to the embodiment may be fixed on the substrate 13, so the dipole antenna 1 can be of higher structural strength and lower failure rate; besides, as the first radiator 11 and the second radiator 12 of the dipole antenna 1 may be rectangular, the dipole antenna 1 can be easily moved by a nozzle, so can be directly installed on a printed circuit board via the surface mount technology (SMT); thus, the assembly of the dipole antenna 1 can be of high efficiency.

The embodiment just exemplifies the present disclosure and is not intended to limit the scope of the present disclosure; any equivalent modification and variation according to the spirit of the present disclosure is to be also included within the scope of the following claims and their equivalents.

As shown in FIG. 2, the first radiator 11 of the dipole antenna 1 according to the embodiment may be manufactured by bending a first metal board MB; more specifically, the first metal board MB may include 5 blocks; the width of the blocks at the top and the bottom may be shorter than the width of other blocks; however, the length of the blocks at the top and the bottom may be longer than the length of other blocks; accordingly, the first metal board MB can be bent to form the first radiator 11, and make the first radiator 11 have the first planar connection part 111 and the first solid radiating part 112.

Similarly, the second radiator 12 of the dipole antenna 1 according to the embodiment may be manufactured by bending a second metal board having the structure the same with that of the first metal board MB, and make the second radiator 12 have the second planar connection part 121 and the second solid radiating part 122.

As described above, both the first radiator 11 and the second radiator 12 of the dipole antenna 1 can be fixed on the substrate 13, and can be manufactured by bending metal boards; thus, the dipole antenna 1 can have higher structural strength, and the characteristics thereof can also be easily adjusted.

As shown in FIG. 1, when a designer designs the characteristics of the dipole antenna 1, the designer can adjust the impedance matching of the dipole antenna 1 by modifying the distance D3 between the first solid radiating part 112 and the second solid radiating part 122. The designer can adjust the impedance matching of the dipole antenna 1 by modifying the distance D4 between the first planar connection part 111 and the second planar connection part 121. The designer can adjust the resonance between the first solid radiating part 112 and the second solid radiating part 122 by modifying the height H of the first solid radiating part 112 and the second solid radiating part 122.

Moreover, in the embodiment, the dipole antenna 1 may be a dual-band antenna, and the operating frequency bands thereof may include a first frequency band and a second frequency band; the first frequency band may be higher than the second frequency band. The designer can adjust the first frequency band by modifying the distance D3 between the first solid radiating part 112 and the second solid radiating part 122; in addition, the designer can adjust the second frequency band by modifying the distance D1 between the feed point F and the other end of the first solid radiating part 112, and the distance D2 between the ground pint G and the other end of the second solid radiating part 122. Furthermore, in another preferred embodiment, the dipole antenna 1 may be a single-band antenna.

As described above, the first radiator 11 and the second radiator of the dipole antenna 1 according to the embodiment can be manufactured by bending metal boards to be of rectangle or other polygons without generating any waste material; thus, the cost of the dipole antenna 1 can be further reduced; besides, the above manufacturing method can easily control the size of the dipole antenna 1, so the characteristics of the dipole antenna 1 can be easily adjusted; thus, the application of the dipole antenna 1 can be more comprehensive.

The embodiment just exemplifies the present disclosure and is not intended to limit the scope of the present disclosure; any equivalent modification and variation according to the spirit of the present disclosure is to be also included within the scope of the following claims and their equivalents.

It is worthy to point out that the two radiators of the conventional dual-band dipole antenna are only connected by one coaxial cable, and sleeved by the heat-shrinkable sleeves; thus, its structural strength is low; for the reason, the conventional dual-band dipole antenna tends to be broken due to external force, which significantly increases the failure rate of the conventional dual-band dipole antenna. On the contrary, according to one embodiment of the present disclosure, the first radiator and the second radiator of the dipole antenna can be fixed on the substrate (printed circuit board), so its structural strength can be obviously increased; therefore, the dipole antenna will not be easily broken by external force, so its failure rate can be extremely low.

According to one embodiment of the present disclosure, the first radiator and the second radiator of the dipole antenna can be fixed on the substrate (printed circuit board), so its structural strength can be obviously increased; therefore, the dipole antenna will not be easily broken by external force, so its failure rate can be extremely low.

In addition, as the radiators of the conventional dual-band dipole antenna are hollow cylinders, which should be manufactured by lathing solid metal cylinders; thus, the above manufacturing process will generate a lot of waste materials, which significantly increases the cost of the conventional dual-band dipole antenna. On the contrary, according to one embodiment of the present disclosure, the first radiator and the second radiator of the dipole antenna may be of rectangle or other polygons, so can be directly manufactured by bending metal boards without generating any waste material; thus, the cost of the dipole antenna can be further reduced.

Besides, as the radiators of the conventional dual-band dipole antenna should be manufactured by lathing solid metal cylinders, its size cannot be easily controlled; thus, it is very hard to adjust the characteristics of the conventional dual-band antenna, which significantly limits the application of the conventional dual-bank antenna. On the contrary, according to one embodiment of the present disclosure, the first radiator and the second radiator of the dipole antenna can be directly manufactured by bending metal boards, so its size can be easily controlled, and its characteristics can also be easily adjusted; therefore, the application of the dipole antenna can be more comprehensive.

Moreover, as the radiators of the conventional dual-band dipole antenna are hollow cylinders, so cannot be moved by a nozzle, and cannot be fixed on a printed circuit board; thus, the conventional dual-band dipole antenna can only be manually installed on a printed circuit board rather than the surface mount technology (SMT); therefore, the assembly of the conventional dual-band dipole antenna is of low efficiency. On the contrary, according to one embodiment of the present disclosure, the first radiator and the second radiator of the dipole antenna may be of rectangle or other polygons, so the dipole antenna can be easily fixed on a printed circuit board and moved by a nozzle; therefore, the dipole antenna can be directly installed on a printed circuit board by the surface mount technology (SMT); therefore, the assembly of the dual-band dipole antenna is of high efficiency.

Furthermore, according to one embodiment of the present disclosure, the dipole antenna can achieve better performance, and can be adjusted to have one operating frequency band or two operating frequency bands; thus, the dipole antenna can be a single-band antenna or a dual-band antenna, so is more flexible in use.

Figure 3:
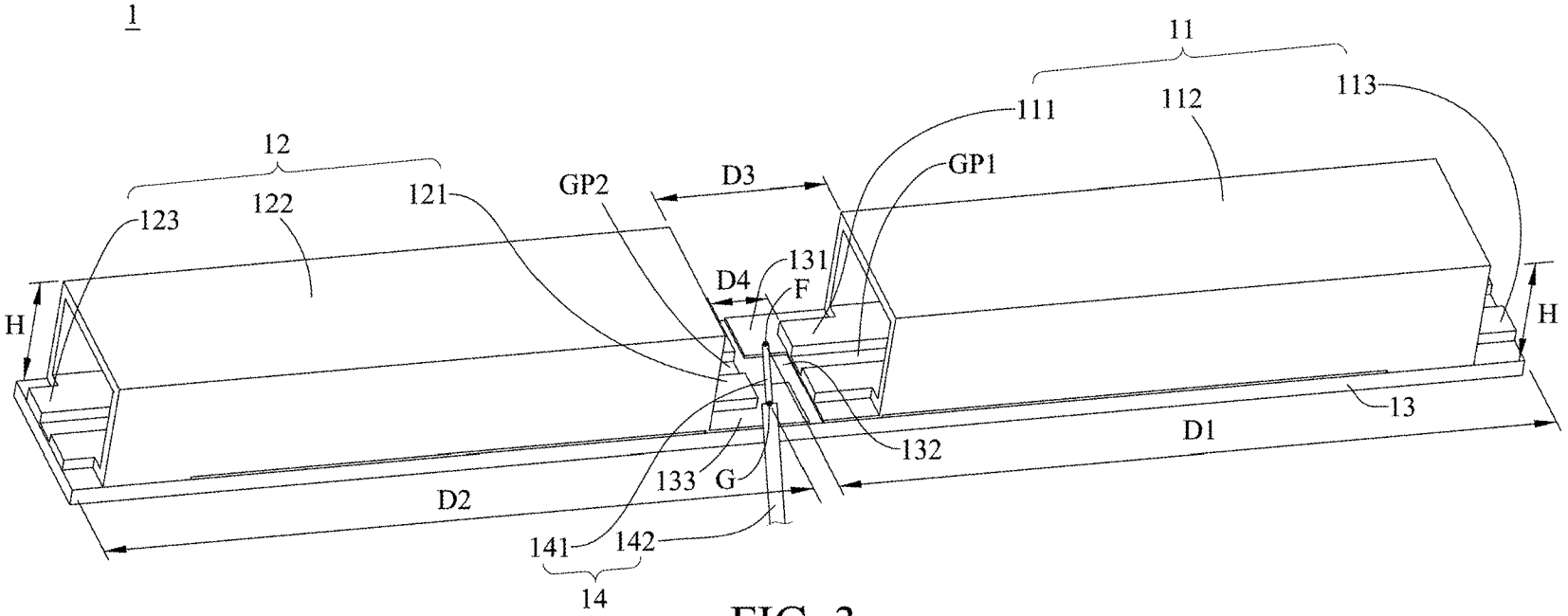
FIG. 3 is a first schematic view of a second embodiment of a dipole antenna of in accordance with the present disclosure.
Figure 4:
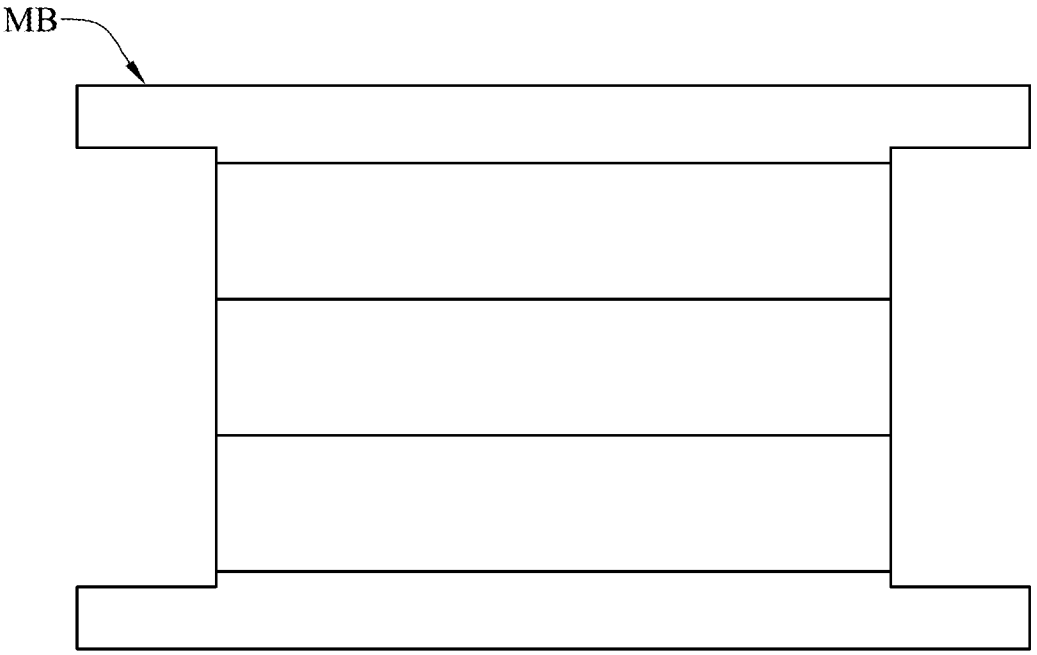
FIG. 4 is a second schematic view of the second embodiment of the dipole antenna of in accordance with the present disclosure.

Please refer to FIG. 3 and FIG. 4, which are a first schematic view and a second schematic view of a second embodiment of a dipole antenna of in accordance with the present disclosure respectively; as shown in FIG. 3, the dipole antenna 1 may include a substrate 13, a first radiator 11 and a second radiator 12.

The substrate 13 may include a first metal layer 131, a second metal layer 132 and an isolation layer 133. The first metal layer 131 and the second metal layer 132 may be disposed on the same side of the substrate 13, and may be adjacent to each other; the isolation layer 133 may be disposed between the first metal layer 131 and the second metal layer 132; the first metal layer 131 may include a feed point F, and the feed point F may be connected to the signal wire 141 of the coaxial cable 14; the second metal layer 132 may include a ground pint G, and the ground pint G may be connected to the ground layer 142 of the coaxial cable 14.

The first radiator 11 may be fixed on the substrate 13, and may include a first planar connection part 111, a first solid radiating part 112 and a first planar extension part 113; the first solid radiating part 112 may be a hollow rectangular hollow column, and may have two openings at two opposite ends thereof respectively; the first planar connection part 111 may be disposed on one end of the first solid radiating part 112 and may be connected to the first metal layer 131, and the first planar extension part 113 may be disposed on the other end of the first solid radiating part 112; the distance D1 between the feed point F and the distal end of the first planar extension part 113 may be ¼λ. In addition, the first radiator 11 may further include a first gap GP1, and the first cap GP1 may penetrate through the first planar connection part 111, the bottom of the first solid radiating part 112 and the first planar extension part 113.

The second radiator 12 may be fixed on the substrate 13, and may include a second planar connection part 121, a second solid radiating part 122 and a second planar extension part 123; the second solid radiating part 122 may be a hollow rectangular hollow column, and may have two openings at two opposite ends thereof respectively; the second planar connection part 121 may be disposed on one end of the second solid radiating part 122 and may be connected to the second metal layer 132, and the second planar extension part 123 may be disposed on the other end of the second solid radiating part 122; the distance D2 between the ground point G and the distal end of the second planar extension part 123 may be ¼λ. In addition, the second radiator 12 may further include a second gap GP2, and the second cap GP2 may penetrate through the second planar connection part 121, the bottom of the second solid radiating part 122 and the second planar extension part 123.

In the embodiment, the first radiator 11 and the second radiator 12 may be disposed at the same side of the substrate 13; besides, the first planar connection part 111 of the first radiator 11 may face the second planar connection part 121 of the second radiator 12.

Similarly, in the embodiment, the first solid radiating part 112 and the second solid radiating part 122 may be of rectangle; in other preferred embodiments, the first solid radiating part 112 and the second solid radiating part 122 may be of other polygons.

As described above, the difference between the dipole antenna 1 of the embodiment and that of the previous embodiment is that the first radiator 11 may further include the first planar extension part 113, and the second radiator 12 may further include the second planar extension part 123; in addition, the first radiator 11 and the second radiator 12 may further include the first gap GP1 and the second gap GP2 respectively. The first radiator 11 and the second radiator 12 of the dipole antenna 1 can also be fixed on the substrate 13, so can have higher structural strength and lower failure rate; further, the dipole antenna 1 can also be directly installed on a printed circuit board by the surface mount technology (SMT), so the assembly of the dipole antenna 1 can be of high efficiency.

The embodiment just exemplifies the present disclosure and is not intended to limit the scope of the present disclosure; any equivalent modification and variation according to the spirit of the present disclosure is to be also included within the scope of the following claims and their equivalents.

As shown in FIG. 4, the first radiator 11 of the dipole antenna 1 according to the embodiment may be manufactured by bending a first metal board MB; more specifically, the first metal board MB may include 5 blocks; the width of the blocks at the top and the bottom may be shorter than the width of other blocks; however, the length of the blocks at the top and the bottom may be longer than the length of other blocks; accordingly, the first metal board MB can be bent to form the first radiator 11, and make the first radiator 11 have the first planar connection part 111, the first solid radiating part 112 and the first planar extension part 113.

Similarly, the second radiator 12 of the dipole antenna 1 according to the embodiment may be manufactured by bending a second metal board having the structure the same with that of the first metal board MB, and make the second radiator 12 have the second planar connection part 121, the second solid radiating part 122 and the second planar extension part 123.

As described above, both the first radiator 11 and the second radiator 12 of the dipole antenna 1 can be fixed on the substrate 13, and can be manufactured by bending metal boards; thus, the dipole antenna 1 can have higher structural strength, and the characteristics thereof can also be easily adjusted.

As shown in FIG. 3, when a designer designs the characteristics of the dipole antenna 1, the designer can adjust the impedance matching and the resonance of the dipole antenna 1 by the same ways described in the previous embodiment. Similarly, in the embodiment, the dipole antenna 1 may be a dual-band antenna, and the operating frequency bands thereof may include a first frequency band and a second frequency band; the first frequency band may be higher than the second frequency band. The designer can adjust the first frequency band by the same way described in the previous embodiment; besides, the designer can adjust the second frequency by modifying the distance D1 between the feed point F and the distal end of the first planar extension part 113, and the distance D2 between the ground pint G and the distal end of the second planar extension part 123. Furthermore, in another preferred embodiment, the dipole antenna 1 may be a single-band antenna.

As the same with the previous embodiment, the first radiator 11 and the second radiator of the dipole antenna 1 according to the embodiment can be manufactured by bending metal boards to be of rectangle or other polygons without generating any waste material; thus, the cost of the dipole antenna 1 can be further reduced; besides, the above manufacturing method can easily control the size of the dipole antenna 1, so the characteristics of the dipole antenna 1 can be easily adjusted; thus, the application of the dipole antenna 1 can be more comprehensive.

The embodiment just exemplifies the present disclosure and is not intended to limit the scope of the present disclosure; any equivalent modification and variation according to the spirit of the present disclosure is to be also included within the scope of the following claims and their equivalents.

Figure 5:
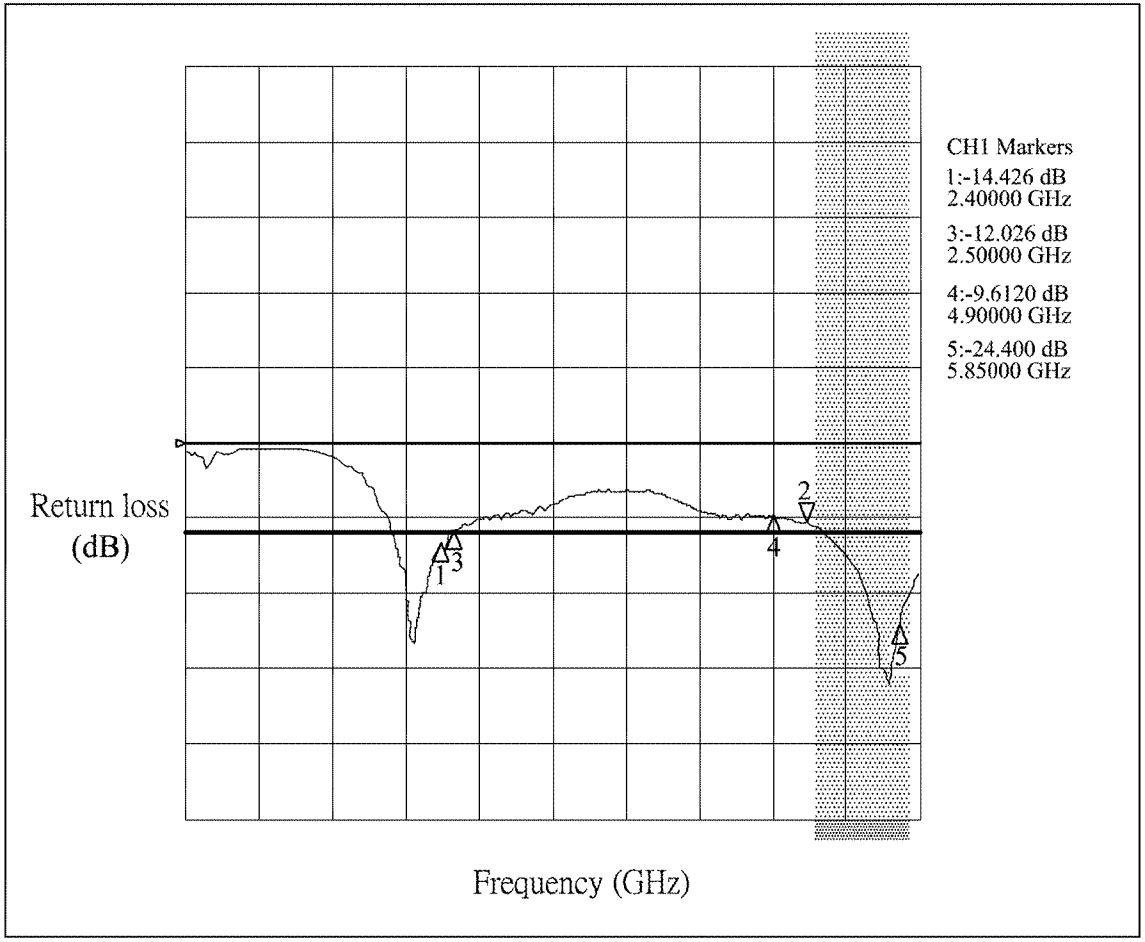
FIG. 5 is a third schematic view of the second embodiment of the dipole antenna of in accordance with the present disclosure.

Please refer to FIG. 5, which are a third schematic view of the second embodiment of the dipole antenna of in accordance with the present disclosure. FIG. 5 illustrates the return loss/frequency curve diagram of the dipole antenna 1 of the embodiment in the 5G frequency band; as shown in FIG. 5, the dipole antenna 1 of the embodiment can achieve great performance.

Figure 6:
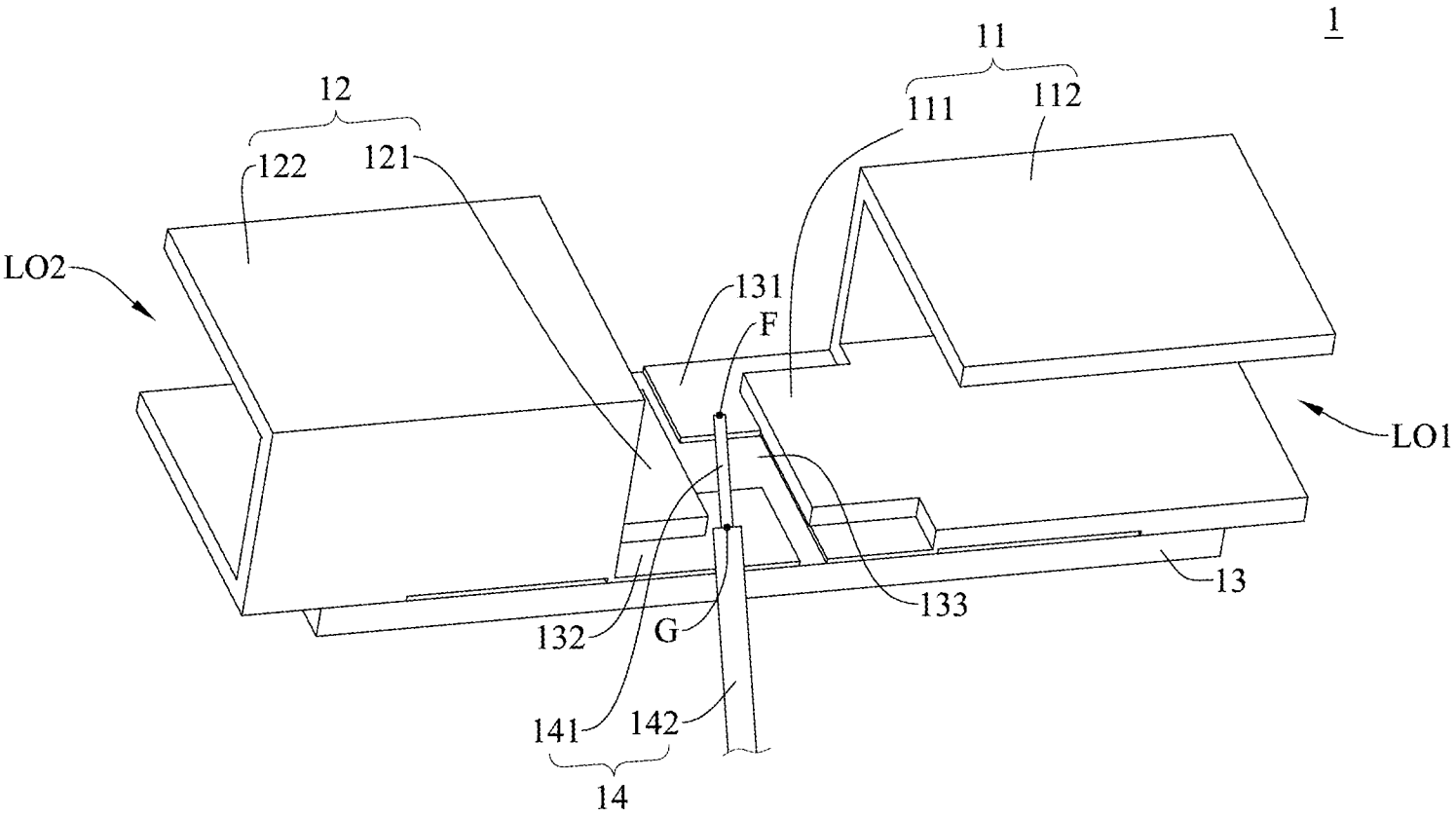
FIG. 6 is a schematic view of a third embodiment of a dipole antenna of in accordance with the present disclosure.

Please refer to FIG. 6, which are a schematic view of a third embodiment of a dipole antenna of in accordance with the present disclosure; as shown in FIG. 6, the dipole antenna 1 may include a substrate 13, a first radiator 11 and a second radiator 12.

In the embodiment, the structure of the first radiator 11 and the second radiator 12 of the dipole antenna 1 are different from those of the first embodiment; more specifically, the first radiator 11 may include a first lateral opening LO1, and the second radiator 12 may include a second lateral opening LO2; the direction which the first lateral opening LO1 faces may be contrary to the direction which the second lateral opening LO2; the above structure may further optimize the performance of the dipole antenna 1.

The structures of the other elements of the dipole antenna 1 are similar to those of the first embodiment, so will not be described herein.

The embodiment just exemplifies the present disclosure and is not intended to limit the scope of the present disclosure; any equivalent modification and variation according to the spirit of the present disclosure is to be also included within the scope of the following claims and their equivalents.

Figure 7:
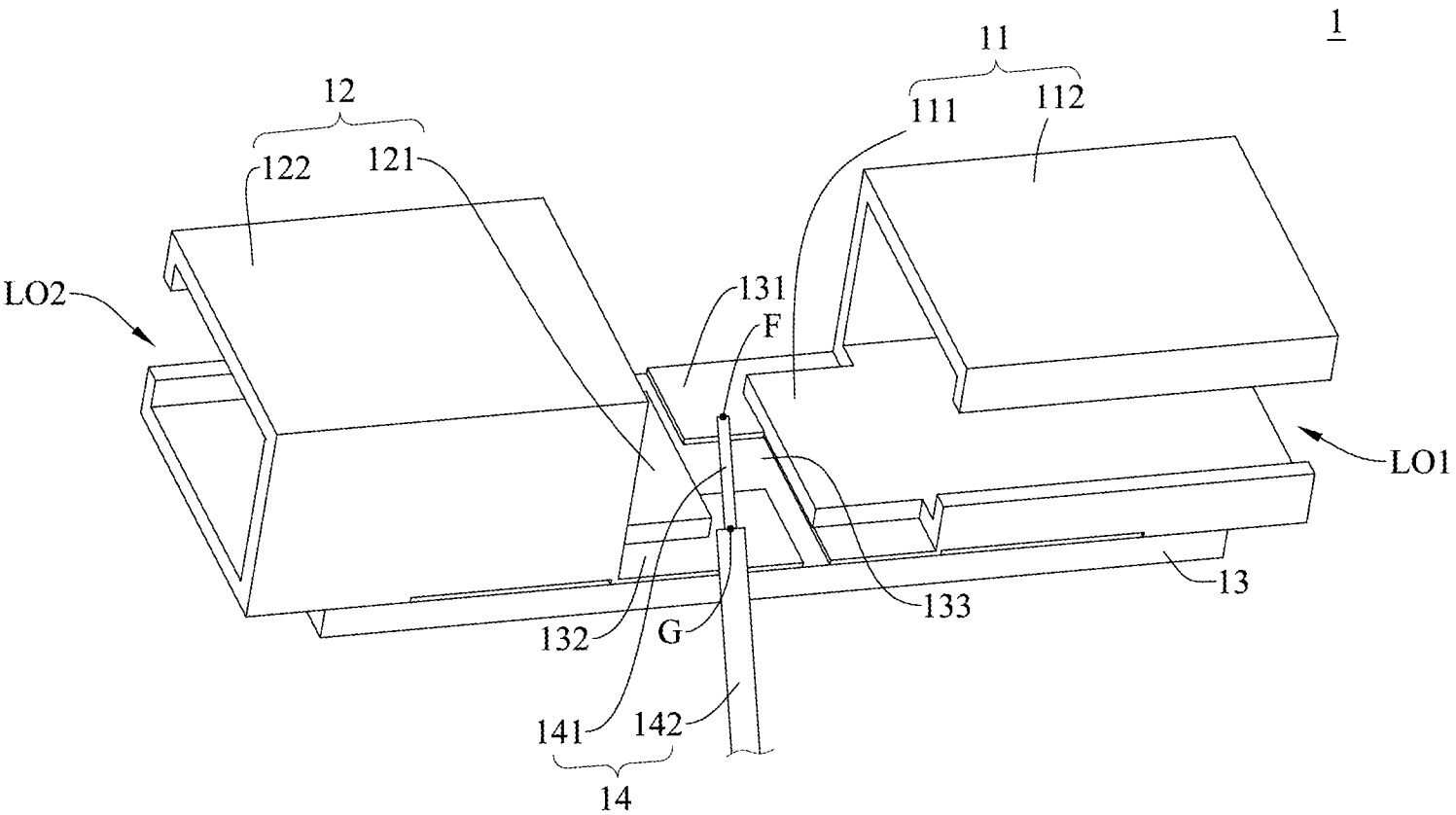
FIG. 7 is a schematic view of a fourth embodiment of a dipole antenna of in accordance with the present disclosure.

Please refer to FIG. 7, which are a schematic view of a fourth embodiment of a dipole antenna of in accordance with the present disclosure; as shown in FIG. 7, the dipole antenna 1 may include a substrate 13, a first radiator 11 and a second radiator 12.

Similarly, in the embodiment, the structure of the first radiator 11 and the second radiator 12 of the dipole antenna 1 are different from those of the first embodiment; more specifically, the first radiator 11 may include a first lateral opening LO1, and the width of the first lateral opening LO1 may be lower than the height of the first radiator 11, such that the first radiator 11 may be a rectangular hollow column not completely sealed; the second radiator 12 may include a second lateral opening LO2, and the width of the second lateral opening LO2 may be lower than the height of the second radiator 12, such that the second radiator 12 may be a rectangular hollow column not completely sealed; the direction which the first lateral opening LO1 faces may be contrary to the direction which the second lateral opening LO2; the above structure may also further optimize the performance of the dipole antenna 1.

The structures of the other elements of the dipole antenna 1 are similar to those of the first embodiment, so will not be described herein.

The embodiment just exemplifies the present disclosure and is not intended to limit the scope of the present disclosure; any equivalent modification and variation according to the spirit of the present disclosure is to be also included within the scope of the following claims and their equivalents.

To sum up, according to one embodiment of the present disclosure, the first radiator and the second radiator of the dipole antenna can be fixed on the substrate (printed circuit board), so its structural strength can be obviously increased; therefore, the dipole antenna will not be easily broken by external force, so its failure rate can be extremely low.

According to one embodiment of the present disclosure, the first radiator and the second radiator of the dipole antenna may be of rectangle or other polygons, so can be directly manufactured by bending metal boards without generating any waste material; thus, the cost of the dipole antenna can be further reduced.

Besides, according to one embodiment of the present disclosure, the first radiator and the second radiator of the dipole antenna can be directly manufactured by bending metal boards, so its size can be easily controlled, and its characteristics can also be easily adjusted; therefore, the application of the dipole antenna can be more comprehensive.

Moreover, according to one embodiment of the present disclosure, the first radiator and the second radiator of the dipole antenna may be of rectangle or other polygons, so the dipole antenna can be easily installed on a printed circuit board and moved a by nozzle; therefore, the dipole antenna can be directly installed on a printed circuit board by the surface mount technology (SMT); therefore, the assembly of the dual-band dipole antenna is of high efficiency.

Furthermore, according to one embodiment of the present disclosure, the dipole antenna can achieve better performance, and can be adjusted to have one operating frequency band or two operating frequency bands; thus, the dipole antenna can be a single-band antenna or a dual-band antenna, so is more flexible in use.

It will be apparent to those skilled in the art that various modifications and variations can be made to the disclosed embodiments. It is intended that the specification and examples be considered as exemplary only, with a true scope of the disclosure being indicated by the following claims and their equivalents.

What is claimed is:

1. A dipole antenna, comprising:

a substrate, comprising a first metal layer and a second metal layer, wherein the first metal layer and the second metal layer are disposed on the same side of the substrate and adjacent to each other; the first metal layer comprises a feed point, and the feed point is connected to a signal wire of a coaxial cable; the second metal layer comprises a ground pint, and the ground point is connected to a ground layer of the coaxial cable;

a first radiator, comprising a first planar connection part, disposed on the first metal layer, and a first solid radiating part which is L-shaped, comprising a first portion and a second portion, wherein the first portion is connected to an end of the first planar connection part and extends in a direction perpendicular to the first planar connection part, and the second portion is connected to an end of the first portion and extends in a direction parallel to the first planar connection part; and a second radiator, comprising a second planar connection part, disposed on the second metal layer, and a second solid radiating part, which is L-shaped, comprising a first portion and a second portion, wherein the first portion is connected to an end of the second planar connection part and extends in a direction perpendicular to the second planar connection part, and the second portion is connected to an end of the first portion and extends in a direction parallel to the second planar connection part.

2. The dipole antenna of claim 1, wherein the substrate further comprising an isolation layer, disposed between the first metal layer and the second metal layer.

3. The dipole antenna of claim 1, wherein the first radiator further comprises a first planar extension part disposed at an end of the first solid radiating part, and the second radiator further comprises a second planar extension part disposed at an end of the second solid radiating part.

4. The dipole antenna of claim 3, wherein the first radiator further comprises a first gap, and the first gap penetrates through the first planar connection part, a bottom of the first solid radiating part and the first planar extension part; the second radiator further comprises a second gap, and the second gap penetrates through the second planar connection part, a bottom of the second solid radiating part and the second planar extension part.

5. The dipole antenna of claim 1, wherein the first solid radiating part comprises a first lateral opening, and the second solid radiating part comprises a second lateral opening; a direction which the first lateral opening faces is contrary to a direction which the second lateral opening.

6. The dipole antenna of claim 1, wherein a distance between the feed point and an end of the first solid radiating part, and a distance between the ground point and an end of the second solid radiating part are ¼λ.

7. The dipole antenna of claim 1, wherein an impedance matching of the dipole antenna is able to be adjusted by modifying a distance between the first solid radiating part and the second solid radiating part.

8. The dipole antenna of claim 1, wherein an impedance matching of the dipole antenna is able to be adjusted by modifying a distance between the first planar connection part and the second planar connection part.

9. The dipole antenna of claim 1, wherein a resonance between the first solid radiating part and the second solid radiating part is able to be adjusted by modifying a height of the first solid radiating part and a height of the second solid radiating part.

10. The dipole antenna of claim 1, wherein operating frequency bands of the dipole antenna comprises a first frequency band and a second frequency band; the first frequency band is higher than the second frequency band; the first frequency band is able to be adjusted by modifying a distance between the first solid radiating part and the second solid radiating part.

11. The dipole antenna of claim 10, wherein the second frequency band is able to be adjusted by modifying a distance between the feed point and an end of the first solid radiating part, and a distance between the ground point and an end of the second solid radiating part.

12. A dipole antenna, comprising:

a substrate;

a first radiator, wherein the first radiator is formed by bending a first metal board, and comprises a first planar connection part and a first solid radiating part, which is L-shaped, comprising a first portion and a second portion, wherein the first portion is connected to an end of the first planar connection part and extends in a direction perpendicular to the first planar connection part, and the second portion is connected to an end of the first portion and extends in a direction parallel to the first planar connection part; and a second radiator, wherein the second radiator is formed by bending a second metal board, and comprises a second planar connection part and a second solid radiating part, which is L-shaped, comprising a first portion and a second portion, wherein the first portion is connected to an end of the second planar connection part and extends in a direction perpendicular to the second planar connection part, and the second portion is connected to an end of the first portion and extends in a direction parallel to the second planar connection part;

wherein the first radiator and the second radiator are disposed on the same side of the substrate, and the first planar connection part is opposite to the second planar connection part.

13. The dipole antenna of claim 12, wherein the second frequency band is able to be adjusted by modifying a distance between the feed point and an end of the first solid radiating part, and a distance between the ground point and an end of the second solid radiating part.

14. The dipole antenna of claim 12, wherein operating frequency bands of the dipole antenna comprises a first frequency band and a second frequency band; the first frequency band is higher than the second frequency band;

the first frequency band is able to be adjusted by modifying a distance between the first solid radiating part and the second solid radiating part.

15. The dipole antenna of claim 12, wherein the substrate comprises a first metal layer and a second metal layer; the first metal layer and the second metal layer are disposed on the same side of the substrate and adjacent to each other; the first metal layer is connected to the first planar connection part, and comprises a feed point; the feed point is connected to a signal wire of a coaxial cable; the second metal layer is connected to the second planar connection part, and comprises a ground point; the ground point is connected to a ground layer of the coaxial cable.

* * * * *